US006380872B1

(12) United States Patent
Yun

(10) Patent No.: US 6,380,872 B1
(45) Date of Patent: Apr. 30, 2002

(54) METHOD FOR ISSUING A DESTINATION ARRIVAL ALARM IN A RADIO TERMINAL

(75) Inventor: Sung-Hm Yun, Kyongsangbuk-do (KR)

(73) Assignee: Samsung Electronics, Co., Ltd. (KR)

( * ) Notice: Subject to any disclaimer, the term of this patent is extended or adjusted under 35 U.S.C. 154(b) by 0 days.

(21) Appl. No.: 09/460,079

(22) Filed: Dec. 14, 1999

(30) Foreign Application Priority Data

Dec. 16, 1998 (KR) ..... 98-55404

(51) Int. Cl.[7] ..... G08G 1/123
(52) U.S. Cl. ..... 340/994; 701/200
(58) Field of Search ..... 340/994, 995, 340/988, 990, 993, 989; 701/200, 202, 209, 211, 213

(56) References Cited

U.S. PATENT DOCUMENTS 5,808,565 A * 9/1998 Matta et al. ..... 340/944
5,955,974 A * 9/1999 Togawa ..... 340/944
6,124,810 A * 9/2000 Segal et al. ..... 340/944
6,278,936 B1 * 8/2001 Jones ..... 701/201
6,278,939 B1 * 8/2001 Robare et al. ..... 701/208
6,317,060 B1 * 11/2001 Jones ..... 340/994

* cited by examiner

*Primary Examiner*—John Tweel
(74) *Attorney, Agent, or Firm*—Dilworth & Barrese, LLP

(57) ABSTRACT

A method for issuing a destination arrival alarm in a radio terminal. The radio terminal comprises sending a base station data service request to a base station by user's request; upon receipt of an approval message for the base station data service, sending a destination name to the base station; upon receipt of base station data corresponding to the destination name, displaying the received base station data; selecting at least one of the displayed base station data and storing the selected base station data; upon detection of present base station data, determining whether the detected base station data is identical to the stored base station data; and issuing an alarm, when the detected base station data is identical to the stored base station data.

3 Claims, 4 Drawing Sheets

METHOD FOR ISSUING A DESTINATION ARRIVAL ALARM IN A RADIO TERMINAL

PRIORITY

This application claims priority to an application entitled "Method for Issuing Destination Arrival Alarm in Radio Terminal" filed in the Korean Industrial Property Office on Dec. 16, 1998 and assigned Ser. No. 98-55404, the contents of which are hereby incorporated by reference.

BACKGROUND OF THE INVENTION

1. Field of the Invention

The present invention relates generally to a radio terminal, and in particular, to a method for issuing an alarm when a user of a radio terminal arrives at his destination.

2. Description of the Related Art

While making a long journey to a place by bus or train, one may spend his time sleeping or reading. Sometimes, the traveler may pass his destination due to a deep sleep or absorption in reading. In this case, he suffers a loss of time and expenses. In addition, when the traveler first visits the destination, he should constantly take a look at signposts or ask those around him for the way to the destination. To solve this problem, a navigation device has been developed which uses a GPS (Global Positioning System). However, the navigation device is too expensive to be popularized.

SUMMARY OF THE INVENTION

It is, therefore, an object of the present invention to provide a method for issuing a destination arrival alarm when a user of a radio terminal arrives at his destination.

To achieve the above object, there is provided a method for issuing a destination arrival alarm in a radio terminal. The radio terminal comprises sending a base station data service request to a base station by user's request; upon receipt of an approval message for the base station data service, sending a destination name to the base station; upon receipt of base station data corresponding to the destination name, displaying the received base station data; selecting at least one of the displayed base station data and storing the selected base station data; upon detection of present base station data, determining whether the detected base station data is identical to the stored base station data; and issuing an alarm, when the detected base station data is identical to the stored base station data.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1:
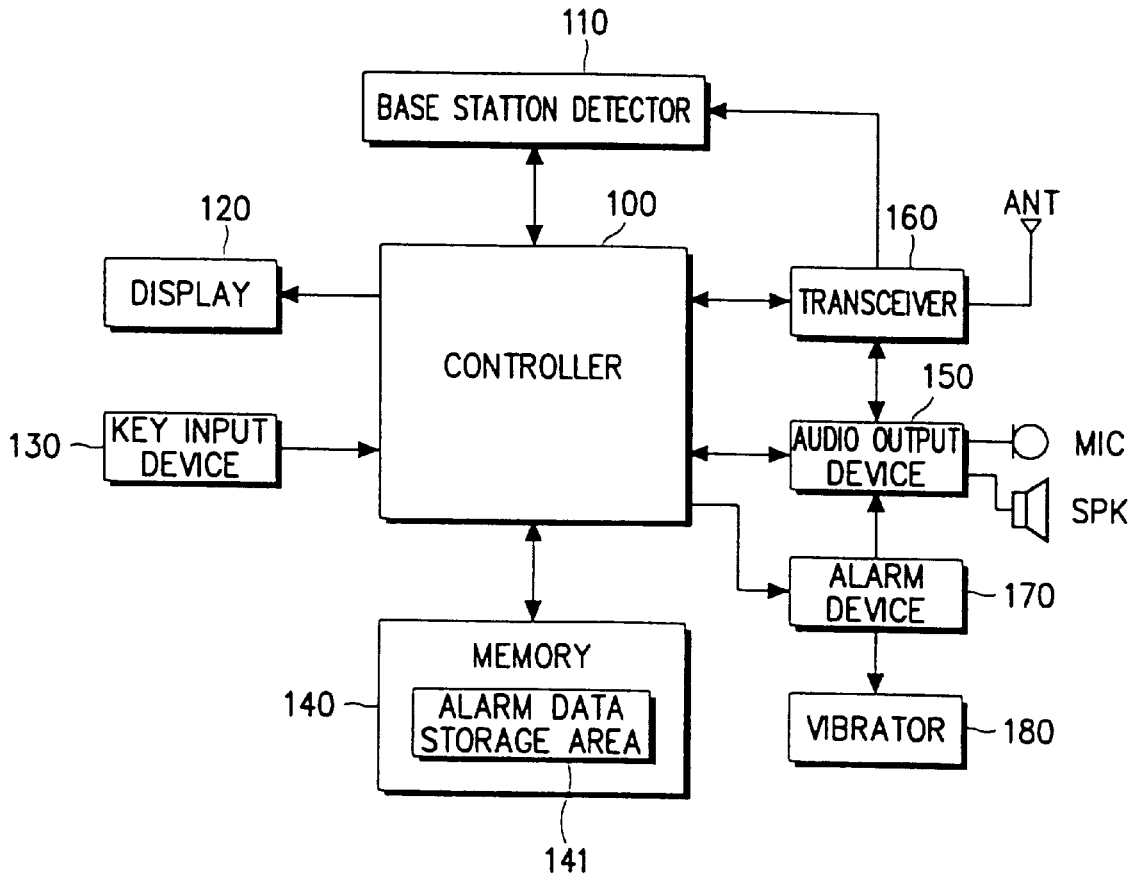
FIG. 1 is a block diagram of a radio terminal according to the present invention.

FIG. 1 shows a block diagram of a radio terminal according to an embodiment of the present invention. A controller 100 controls the overall operation of the radio terminal. In particular, the controller 100 stores base station data of the destination to issue an alarm upon receipt of base station data identical to the stored base station data. A base station detector 110 analyzes a message received through a transceiver 160 from a present base station to which the radio terminal belongs, to detect base station data and provides the detected base station data to the controller 100. A display 120, an LCD (Liquid Crystal Display), displays various display data under the control of the controller 100. A key input device 130 provides key data generated by the user's key operation to the controller 100. A memory 140 stores a control program of the radio terminal and a program for issuing a destination arrival alarm according to the present invention. Further, the memory 140 has an alarm data storage area 141 for storing alarm data comprised of the base station data of the destination and alarm mode data. An audio output device 150, under the control of the controller 100, outputs audio signals through a speaker SPK, and processes audio signals received through a microphone MIC and provides the processed audio signals to the transceiver 160. The transceiver 160 transmits and receives data through an antenna ANT. An alarm device 170 issues an alarm in audio or vibration under the control of the controller 100. A vibrator 180 generates vibration in response to a control signal from the alarm device 170.

Figure 2A:
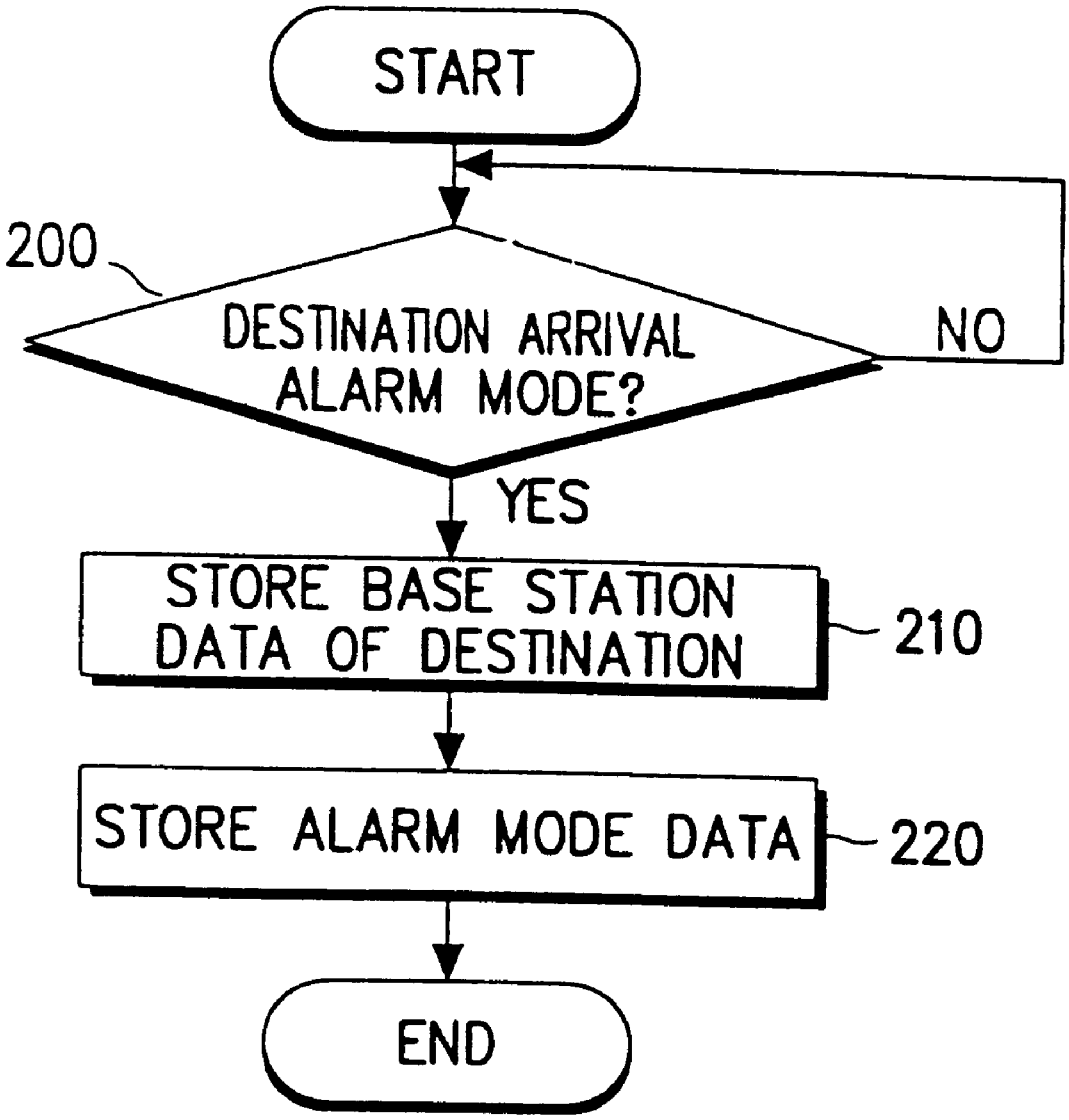
FIG. 2A is a flow chart illustrating a procedure for storing alarm data according to an embodiment of the present invention.
Figure 3:
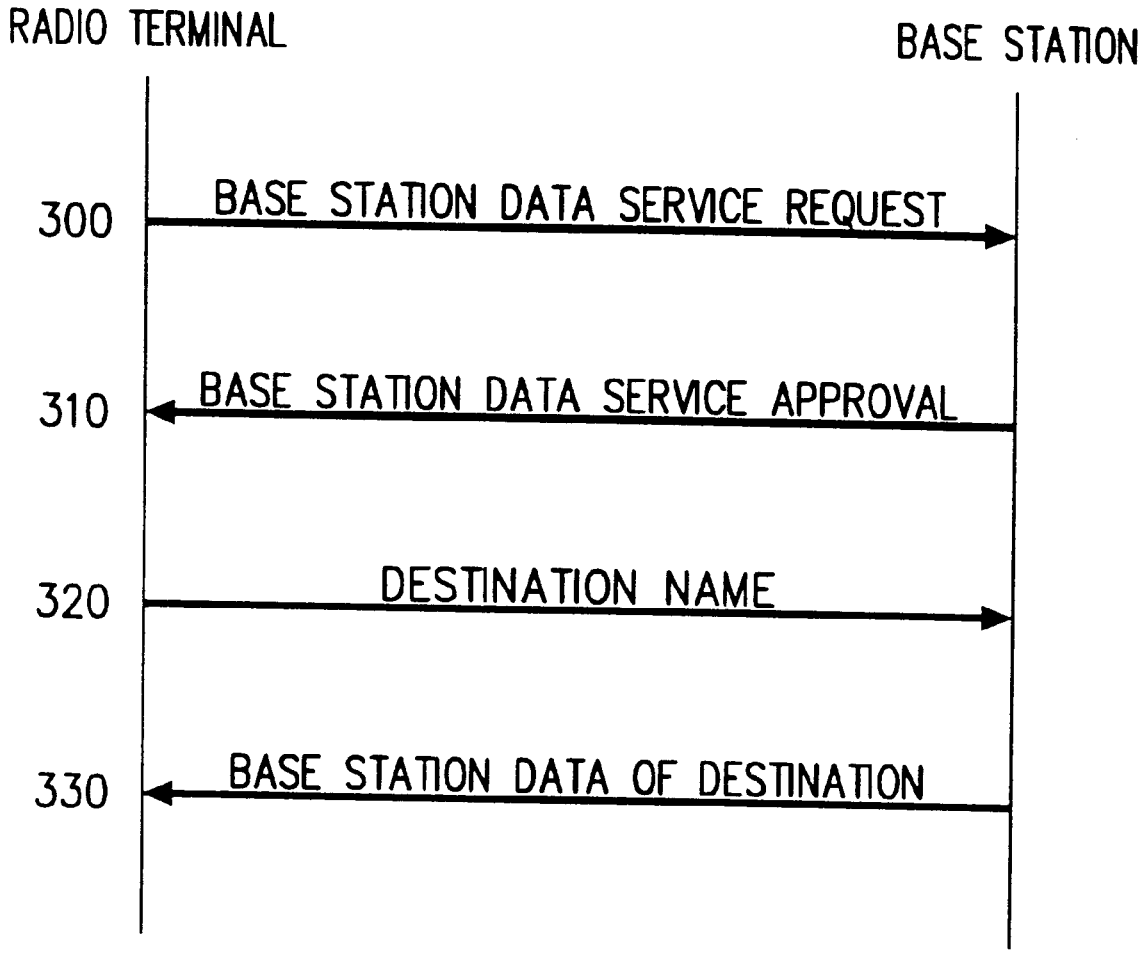
FIG. 3 is a diagram illustrating a procedure for receiving base station data of the destination, performed between a radio terminal and a base station according to an embodiment of the present invention.

FIG. 2A shows a procedure for storing alarm data according to an embodiment of the present invention, and FIG. 3 shows a procedure for receiving base station data of the destination, performed between a radio terminal and a base station according to an embodiment of the present invention.

Referring to FIG. 2A, the controller 100 determines in step 200 whether key data for setting a destination arrival alarm mode is received from the key input device 130. Upon receipt of the key data, the controller 100 receives base station data of the destination through the key input device 130 and stores the received base station data in the memory 140 in step 210, and stores the alarm data in the alarm data storage area 141 of the memory 140, in step 220.

It is desired to store base station data of several destinations, the base station data can be stored in association with corresponding destinations. For example, when the user inputs a destination "New York" using the key input device 130, the controller 100 retrieves base station data for "New York" from a database and displays the retrieved base station data on the display 120, as shown in Table 1.

TABLE 1

| |
|---|
| New York |
| □1230-4567□ |
| 1230-4569 |
| 1230-4568 |

In Table 1, "□" and "□" represent the position of a cursor. The user can select one of the base station data by moving the cursor using arrow keys. When the radio terminal does not have a database for the base station data, the user can directly input the base station data referring to a user's manual. Further, in the case where a communication service provider provides a base station data service, the radio terminal transmits the destination name input by the user, and the base station then transmits base station data of the corresponding destination to the radio terminal. In this manner, it is possible to store alarm data using the received base station data.

FIG. 3 shows a procedure for receiving base station data from the base station. When the radio terminal sends a base station data service request (Step 300), the base station sends a base station data service approval (Step 310). The radio terminal then sends the base station the destination name input by the user (Step 320). Upon receipt of the destination name, the base station retrieves base station data corresponding to the destination name and sends the retrieved base station data to the radio terminal (Step 330). Although FIG. 3 shows data exchange performed between the radio terminal and the base station, the data exchange can be performed with an upper layer when necessary. In this method, the user can input the base station data.

Figure 2B:
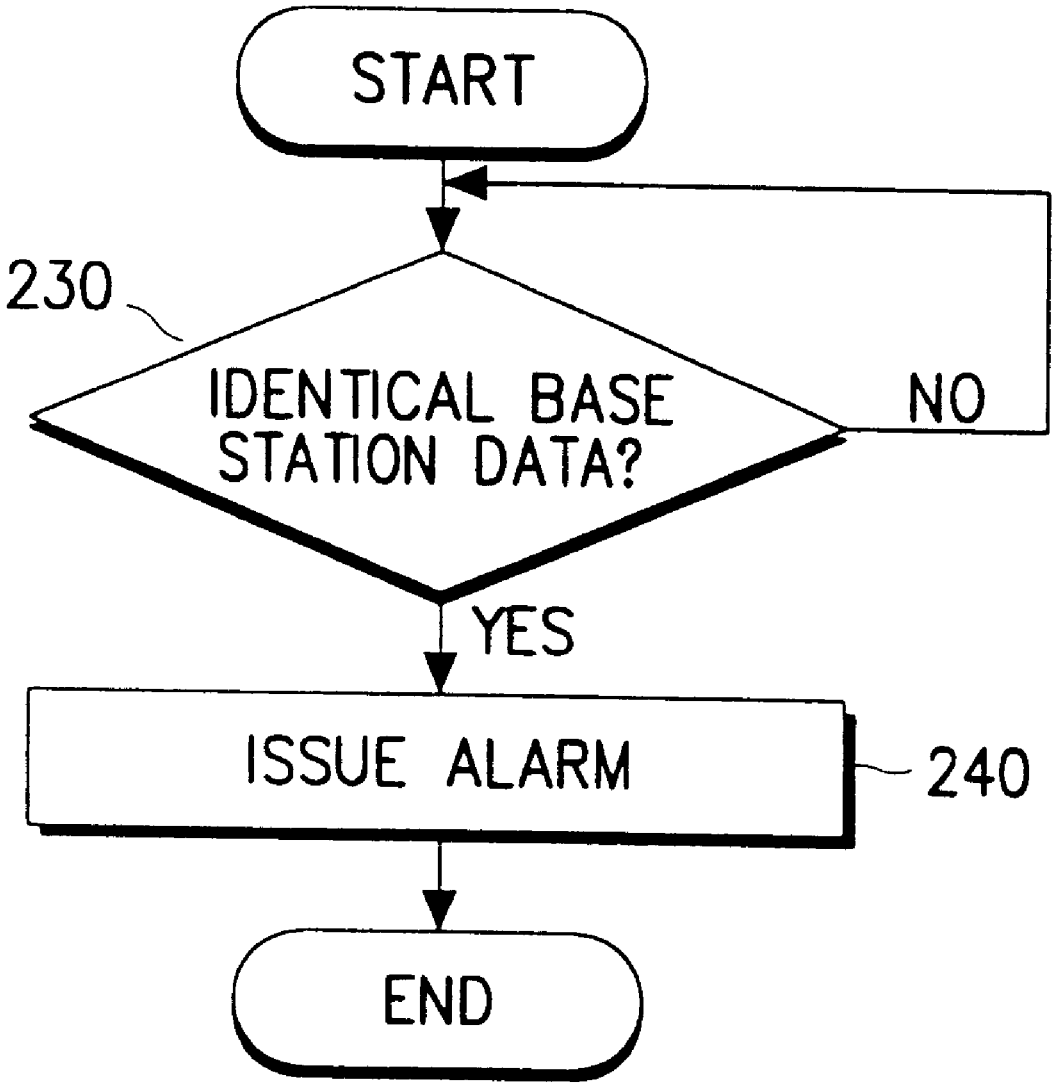
FIG. 2B is a flow chart illustrating a procedure for issuing a destination arrival alarm according to an embodiment of the present invention.

Referring now to FIGS. 2A and 2B, in step 220, the controller 100 receives alarm mode data input by the user and stores the received alarm mode data in the alarm data storage area 141 of the memory 140. Typically, the alarm mode can be divided into a bell mode or a vibration mode. Table 2 below shows the alarm data, by way of example.

TABLE 2

| ON/OFF | Alarm Mode | Base Station Data |
|---|---|---|
| ON | Vibration | 1230-4567 |

FIG. 2B shows a procedure for issuing a destination arrival alarm according to an embodiment of the present invention. Generally, in a cellular mobile communication system, each base station transmits unique base station data to the radio terminal during synchronization. For example, in a CDMA (Code Division Multiple Access) communication system, the base station data is transmitted to the radio terminal through an OTA (Over The air Activation) operation performed during a registration operation between the radio terminal and the base station.

Referring to FIG. 2B, in step 230, the controller 100 detects present base station data using the base station detector 110 and determines whether the detected base station data is identical to the base station data stored in the memory 140. When the detected base station data is identical to the stored base station data, the controller 100 enables the alarm device 170 to issue an alarm, in step 240. The alarm device 170 generates an alarm tone through the audio output device 150 in a bell mode of operation, and enables the vibrator 180 to generate vibration in a vibration mode of operation. At this point, it is also possible to display a message indicating arrival at the destination on the display 120.

To sum up, the base station data of a specific destination is previously stored in the radio terminal. Upon detection of present base station data, the radio terminal determines whether the detected base station data is identical to the previously stored base station data. When the detected base station data is identical to the previously stored base station data, the radio terminal issues an alarm to inform the user of arrival at the destination.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A method for issuing a destination arrival alarm in a radio terminal of a cellular mobile communication system, comprising the steps of:

(a) requesting base station data of several destination base stations from a mobile terminal;

(b) receiving the base station data of several base stations;

(c) selecting at least one destination among the base station data, and storing the selected destination data; and (d) issuing an alarm, when the received base station data is identical to the stored base station data.

2. The method as claimed in claim 1, wherein the step (a) comprises the steps of:

upon receipt of a destination name input by a user, displaying base station data corresponding to the destination name; and selecting one of the displayed base station data and storing the selected base station data.

3. A method for issuing a destination arrival alarm in a radio terminal of a cellular mobile communication system, comprising the steps of:

sending a base station data service request for requesting destination data to a base station of the cellular mobile communication system;

sending a destination data decided by a user to the base station;

upon receipt of a plurality of base station data corresponding to the destination data, displaying the received base station data;

selecting at least one of the displayed base station data and storing the selected base station data;

upon detection of present base station data, determining whether the detected base station data is identical to the stored base station data; and issuing an alarm, when the detected base station data is identical to the stored base station data.

* * * * *